US005579395A

United States Patent [19]

Horl

[11] Patent Number: 5,579,395

[45] Date of Patent: Nov. 26, 1996

[54] STEREO DECODER WITH CROSS-TALK COMPENSATION

[75] Inventor: Manfred Horl, Hamburg, Germany

[73] Assignee: U.S. Philips Corporation, New York, N.Y.

[21] Appl. No.: 286,607

[22] Filed: Aug. 5, 1994

[30] Foreign Application Priority Data

Aug. 10, 1993 [DE] Germany ..... 43 26 811.0

[51] Int. Cl.[6] ..... H04R 5/00

[52] U.S. Cl. ..... 381/1; 381/3; 381/10

[58] Field of Search ..... 381/1, 10, 28, 381/3, 4

[56] References Cited

U.S. PATENT DOCUMENTS 4,503,554 3/1985 Davis ..... 381/1

4,972,482 11/1990 Ishiguro et al. ..... 381/10

*Primary Examiner*—Forester W. Isen

*Assistant Examiner*—Duc Nguyen

*Attorney, Agent, or Firm*—Bernard Franzblau

[57] ABSTRACT

A circuit arrangement for converting of a stereo signal having a mid-plane signal and a side signal into an output signal for each of two audio signal channels. By this circuit arrangement, a simplified and also automatic crosstalk cancellation is possible. The circuit arrangement includes an adjustment circuit for minimizing crosstalk between the output signals, having a (first) limiter circuit adapted to receive a first one of the output signals and to transform this signal into an at least substantially rectangular (first) amplitude-limited signal of the same frequency, a (first) mixer circuit for deriving a (first) rectified signal by multiplying the (first) amplitude-limited signal by a second one of the output signals, a (first) control circuit for deriving a (first) correction signal from the (first) rectified signal, an adjustment circuit for adjusting the amplitude of the mid-plane signal and/or the side signal by means of the (first) correction signal, a (first) storage device for storing the (first) correction signal, and a (first) switching device by which in a first mode of the circuit arrangement, the (first) correction signal is applied both to the (first) storage device and to the adjustment circuit, and by which, in a second mode of the circuit arrangement, the (first) correction signal stored in the (first) storage device can be applied to the adjustment circuit.

14 Claims, 4 Drawing Sheets

STEREO DECODER WITH CROSS-TALK COMPENSATION

BACKGROUND OF THE INVENTION

1. Field of the Invention

This invention relates to a circuit arrangement for converting a stereo signal comprising a mid-plane signal and a side signal into an output signal for each of two audio signal channels.

2. Description of the Related Art

In such circuit arrangements, the output signals for the audio signal channels are generated by dematrixing the mid-plane signal and the side signal. In customary stereo systems, the mid-plane signal contains audio information about both audio signal channels whereas the side signal preferably contains either audio information about one of the audio channels or, for example, a difference between the audio information of the two audio signal channels. For dematrixing, which is preferably effected by additive or subtractive mixing of the mid-plane signal and the side signal, given amplitude ratios are required in order to achieve a crosstalk-free division of the audio information into the two audio signal channels during dematrixing. These given amplitude ratios may be disturbed, for example, as a result of circuit tolerances or transmission errors, resulting in crosstalk between the two audio signal channels.

SUMMARY OF THE INVENTION

It is an object of the invention to construct a circuit arrangement of the type defined in the opening paragraph in a manner such that during its production, setting-up or operation, a rapid, simple and accurate adjustment possibility is available which enables crosstalk during operation to be eliminated effectively.

According to the invention, this object is achieved by means of a circuit arrangement for converting a stereo signal comprising a mid-plane signal and a side signal into an output signal for each of two audio signal channels, which arrangement comprises an adjustment circuit for minimizing crosstalk between the output signals, comprising a (first) limiter circuit adapted to receive a first one of the output signals and to transform this into an at least substantially rectangular (first) amplitude-limited signal of the same frequency, a (first) mixer circuit for deriving a (first) rectified signal by multiplying the (first) amplitude-limited signal by a second one of the output signals, a (first) control circuit for deriving a (first) correction signal from the (first) rectified signal, an adjustment circuit for influencing the amplitude of the mid-plane signal and/or the side signal by means of the (first) correction signal, a (first) storage device for storing the (first) correction signal, and a (first) switching device by means of which in a first mode of the circuit arrangement the (first) correction signal can be applied both to the (first) storage device in order to be stored and to the adjustment circuit, and by means of which in a second mode of the circuit arrangement the (first) correction signal stored in the (first) storage device can be applied to the adjustment circuit.

The adjustment made possible by the circuit arrangement in accordance with the invention is then carried out in the first mode of operation, in which the adjustment circuit forms a control loop which can be used for minimizing a signal which occurs only in the case of crosstalk between the audio signal channels. Upon completion of the adjustment, the circuit arrangement in accordance with the invention can be used in its second mode of operation for processing, for example, stereo signals received from a transmitter or a record carrier. In this second mode of operation, the adjustment status for the circuit arrangement is preserved by storing the correction signal in the storage device.

In an advantageous method of operating a circuit arrangement in accordance with the invention, in the first mode, the mid-plane signal and the side signal of the stereo signal correspond and the (first) correction signal is adjusted to a value at which the second output signal disappears. This method is used in particular in stereo systems in which the mid-plane signal is transmitted as the sum and the side signal as the difference of the audio signals of the two audio signal channels. The right signal channel is then allocated to the second output signal. In another method in accordance with the invention, for operating the circuit arrangement of the invention the mid-plane signal of the stereo signal in the first mode of operation is the half side signal and the correction signal is also set to a value for which the second output signal disappears. Preferably, this method is used if the mid-plane signal corresponds to the sum of the audio signals of the two audio signal channels and the side signal corresponds to twice the audio signal for the right-hand audio signal channel. Whereas the first-mentioned method is used particularly for European stereo radio and for television sound in accordance with the Korean standard, the second method can be used in particular for the television sound of European television. It is then possible to use an adjustment circuit of the same construction for these different audio-signal transmission standards.

With the circuit arrangement in accordance with the invention and when the above method in accordance with the invention is used, the circuit arrangement can be adjusted, for example, immediately after its manufacture, during the production of an apparatus for the reproduction of stereo audio signals in which the circuit arrangement in accordance with the invention is incorporated, or the first or each time that the circuit arrangement in accordance with the invention is put into operation. The value of the correction signal required for the adjustment is then stored in the storage device and can be read out during operation. For this purpose the circuit arrangement in accordance with the invention preferably comprises a (first) conversion circuit arranged in signal paths for the (first) correction signal between the (first) control circuit, the adjustment circuit and the (first) storage device, and enabling the (first) correction signal supplied by the (first) control circuit to be converted into a form in which it can be stored in the (first) storage device, and enabling a stored (first) correction signal to be converted into a form required for application to the adjustment circuit. A particularly simple and accurate storage is then obtained in that the (first) correction signal is adapted to be stored in the (first) storage device in digital form and the (first) conversion circuit comprises a (first) device for converting the (first) correction signal into this digital form and one for re-converting it from this digital form.

In order to realize the above variants of the use of the adjustment method in accordance with the invention, the correction signal to be stored in digital form may be stored, for example, in a read-only memory which is fixedly associated with the circuit arrangement in accordance with the invention. However, alternatively, the storage device may be arranged in a control system, for example, a bus system, physically separated from the circuit arrangement for converting the stereo signal, which storage device also stores other control and adjustment data. Thus, the invention also enables an automatically controlled adjustment to be carded out in a simple manner, for example, each time that an apparatus which includes the circuit arrangement in accordance with the invention is put into operation. This also enables, for example, aging effects of components and other undesirable effects which are variable in time to be eliminated effectively.

A preferred embodiment of the circuit arrangement in accordance with the invention is characterized in that the (first) device for converting the (first) correction signal into digital form comprises a (first) comparator stage for receiving at a first input the (first) correction signal from the (first) control circuit, and a (first) counter stage, whose counting direction can be defined by an output signal of the (first) comparator stage and whose count can be stored in digital form in the (first) storage device as the (first) correction signal, and in that the (first) device for re-convening the (first) correction signal from the digital form comprises a (first) digital-to-analog converter stage for converting the (first) correction signal from digital form into a form in which it can be applied to the adjustment circuit and in which it can also be applied to a second input of the (first) comparator stage for comparison with the (first) correction signal which can be applied by the (first) control circuit.

Such an arrangement for convening the correction signal, which is of a very simple construction, supplies a very accurate correction signal and can also be used very simply and effectively for supplying a correction signal in digital form and for taking over such a correction signal from the storage device. Preferably, the (first) correction signal stored in the (first) storage device is applied to the (first) counter stage for presetting it to a corresponding count.

In a circuit arrangement of the type described above, a clock signal to be used for setting the (first) counter stage to the value required for the (first) correction signal is advantageously derived from the (first) amplitude-limited signal and is applied to the (first) counter stage as a counting signal. Thus, a rapid operation of the correction arrangement is obtained with the aid of simple means and, particularly, without a separate clock signal generation being necessary.

Preferably, the (first) control circuit comprises an integrator stage and a low-pass stage to generate the (first) correction signal. The low-pass stage serves for rejecting all the a.c. components of mixing products of the (first) mixer circuit because only their d.c. components are needed for the correction signal. However, since a low-pass stage alone gives a residual control error, as a result of which crosstalk would not be eliminated completely, the integrator stage has also been provided to eliminate this control error. This guarantees a complete elimination of crosstalk.

Another embodiment of the circuit arrangement in accordance with the invention is characterized in that the adjustment circuit comprises a second limiter circuit adapted to receive the second output signal and to transform this into an at least substantially rectangular second amplitude-limited signal of the same frequency, a second mixer circuit for deriving a second rectified signal by multiplying the second amplitude-limited signal by the first output signal, a second control circuit for deriving a second correction signal from the second rectified signal, a second storage device for storing the second correction signal, a second switching device by means of which in a first mode of the circuit arrangement the second correction signal can be applied both to the second storage device in order to be stored and to the adjustment circuit, and by means of which in a second mode of the circuit arrangement the second correction signal stored in the second storage device can be applied to the adjustment circuit, and in that in the adjustment circuit the amplitude of the mid-plane signal and/or the side signal can be influenced in mutually different frequency ranges by means of the two correction signals.

This embodiment of the invention is particularly suitable for circuit arrangements for converting a stereo signal, in which the side signal should be subjected to noise cancellation before dematrixing. Such a noise cancellation is particularly advantageous if the side signal is modulated on a higher frequency than the mid-plane signal and consequently exhibits larger noise components. As a result of the special spectral distribution of this noise, it may then be advantageous to make the crosstalk adjustment also frequency dependent. The two correction signals can then be used for the frequency components of the side signal which should be adjusted separately. In the above-mentioned embodiment of the circuit arrangement in accordance with the invention, the individual signal processing stages, which form mutually independent control loops in the control arrangement, may then be constructed accordingly. For example, the first and the second limiter circuit may be of identical construction, which also applies to the first and the second mixer circuit, etc.

A preferred method in accordance with the present invention, for carrying out the crosstalk adjustment with a circuit arrangement according to the invention of the kind comprising two independent control loops as described above, suitably proceeds in such a manner that a test signal is applied as a stereo signal in the first mode, in which test signal the mid-plane signal is formed by additive mixing and the side signal by subtractive mixing of a low-frequency first test wave and a high-frequency second test wave, and the second test wave appears in the side signal in phase opposition to the second test wave in the mid-plane signal, the frequency of the second test wave being a non-integral multiple of the frequency of the first test wave, and in that the first correction signal is adjusted to a value at which components of the first test wave in the second output signal disappear, and the second correction signal is adjusted to a value at which components of the second test wave in the first output signal disappear.

BRIEF DESCRIPTION OF THE DRAWINGS

Exemplary embodiments of the circuit arrangement in accordance with the invention are shown in the drawings and will be described in more detail hereinafter. In the drawings.

DESCRIPTION OF THE PREFERRED EMBODIMENT

Figure 1:
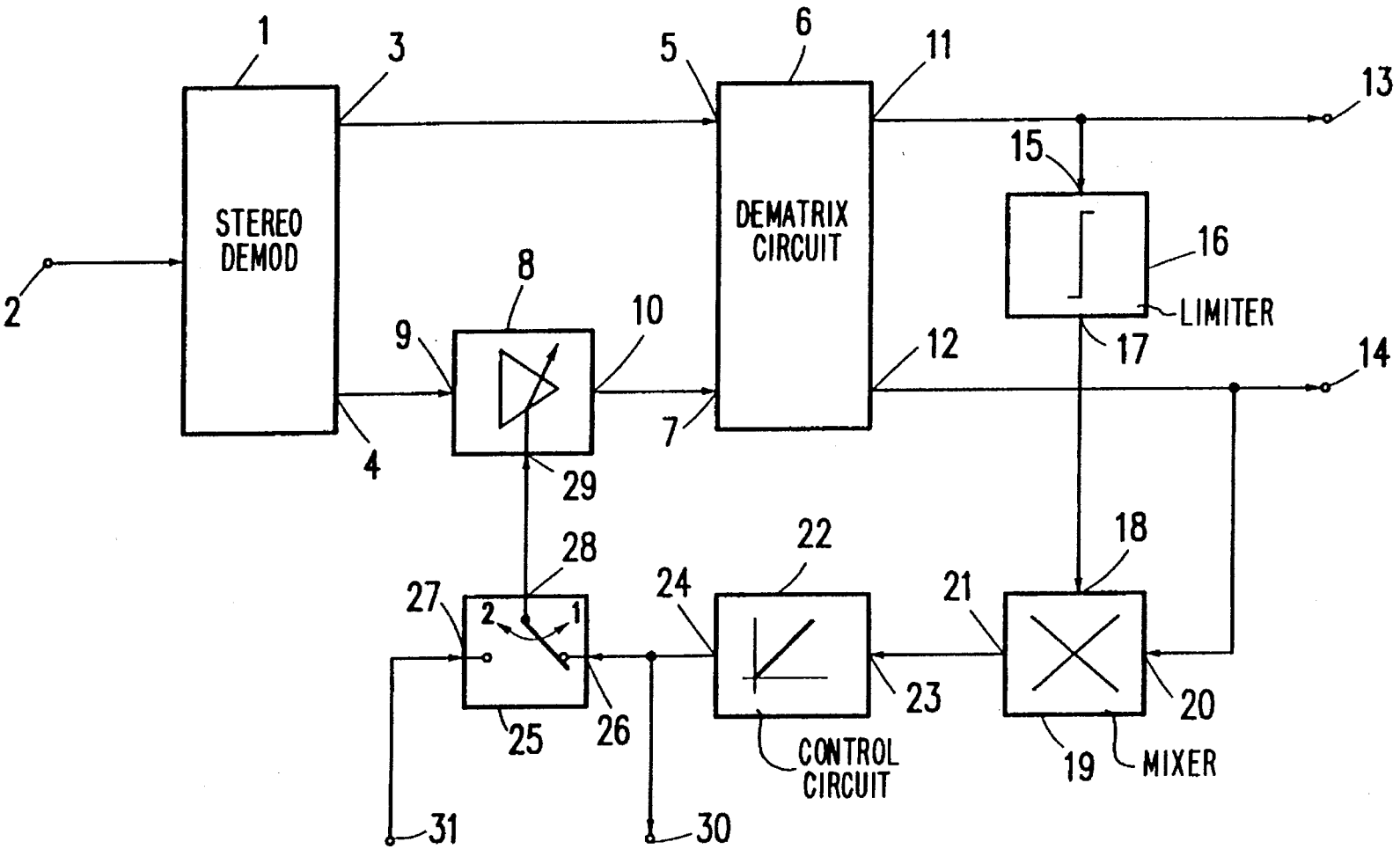
FIG. 1 shows a basic diagram of a circuit arrangement in accordance with the invention and illustrates a method in accordance with the invention for adjusting this circuit arrangement.

In FIG. 1 the reference numeral 1 refers to a stereo demodulator having an input 2 to which a stereo signal is applied which comprises, in customary manner, a mid-plane signal and a side signal in accordance with one of the known transmission standards. From the stereo demodulator 1, the mid-plane signal is supplied to a first output 3 and the side signal is supplied to a second output 4. Depending on the transmission standard used for the stereo signal, the side signal on the second output 4 preferably comprises either a signal which is the difference between the audio signals for the two audio signal channels "left" and "right," or only the audio signal for the right-hand audio signal channel.

The mid-plane signal is applied from the first output 3 of the stereo demodulator 1 to a first input of a dematrixing circuit 6. Likewise, the side signal is applied from the second output 4 of the stereo demodulator 1 to a second input 7 of the dematrixing circuit 6, i.e. in the example shown in FIG. 1 via an adjustment circuit 8, which has an input 9 connected to the second output 4 of the stereo demodulator 1 and an output 10 connected to the second input 7 of the dematrixing circuit 6. In this way the adjustment circuit 8 adjusts the amplitude of the side signal from the stereo demodulator 1 before this signal reaches the dematrixing circuit 6. As a result, the amplitude ratio between the mid-plane signal applied to the dematrixing circuit 6 and the side signal can be adjusted to the appropriate value for crosstalk-free dematrixing.

The dematrixing circuit 6 further comprises two outputs 11, 12 to which the audio signals for the two audio signal channels are supplied and associated output terminals 13 and 14 of the circuit arrangement to which these signals are transferred, for example, for reproduction. Although it is also readily suitable for other transmission standards, the circuit arrangement shown in FIG. 1 will be described hereinafter, by way of example, for processing a stereo signal whose mid-plane signal represents the sum and whose side signal represents the difference of the audio signals for the two audio signal channels. The audio signal for the left-hand audio signal channel is then supplied to the first output 11 of the dematrixing circuit 6 and the audio signal for the right-hand audio signal channel is then supplied to the second output 12 of the dematrixing circuit 6. It is to be noted that as a variant of the circuit arrangement shown in FIG. 1, the adjustment circuit 8 can also be arranged between the first output 3 of the stereo demodulator 1 and the first input 5 of the dematrixing circuit 6 and can then be used likewise for adjusting the amplitude of the mid-plane signal.

Figure 2A:
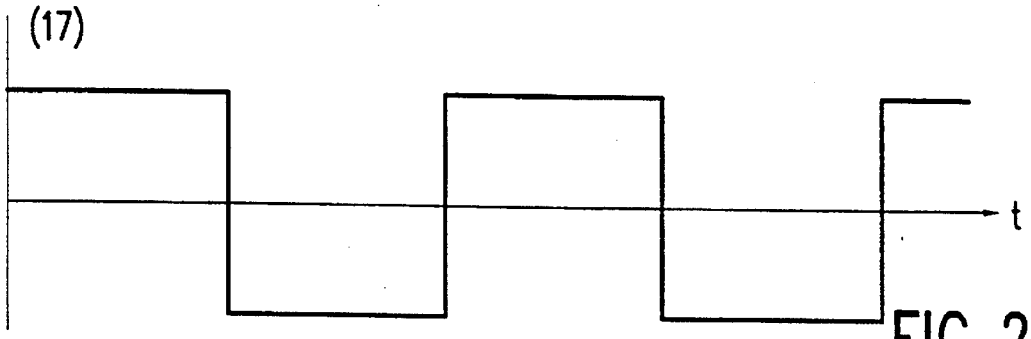
FIGS. 2*a*–2*e* show some examples of signal waveforms in the circuit arrangement shown in FIG. 1.

The first output 11 of the dematrixing circuit 6, which in the present example shown in FIG. 1 corresponds to the left-hand audio signal channel, is further connected to an input 15 of a (first) limiter circuit 16, whose output 17 is connected to a first input 18 of a (first) mixer circuit 19, whose second input 20 is connected to the second output 12 of the dematrixing circuit 6, which second output corresponds to the right-hand audio signal channel. The (first) limiter circuit 16 transforms the output signal appearing on the first output 11 of the dematrixing circuit 6, i.e. an audio signal allocated to the left-hand audio signal channel, into a rectangular (first) amplitude-limited signal, the frequency of the output signal from the output 11 of the dematrixing circuit 6 being maintained. For this purpose, the (first) limiter circuit 16 preferably comprises an amplifier which is overdriven strongly by the output signal on the input 15. FIG. 2*a* shows this rectangular signal for the simple case in which the audio signal for the left-hand audio signal channel is a wave of constant frequency, preferably a sinewave.

If the stereo signal applied to the input 2 of the stereo demodulator 1 is such that, in the case of a correct conversion, it produces an audio signal for the left-hand audio signal channel only, the mid-plane signal will correspond to the side signal of the stereo signal on the input 2 in the case that the side signal represents the difference and the mid-plane signal the sum of the audio signals for the left-hand and the right-hand audio signal channel. Likewise, in the case that the side signal corresponds to twice the audio signal for the right-hand audio signal channel the stereo signal on the input 2 should be such that the mid-plane signal corresponds to half the side signal. In the first case, on which the embodiment shown in FIGS. 1 and 2 is based, the second output signal, which now forms the audio signal for the right-hand audio signal channel, will disappear, and in the second case, the second output signal, which then forms the audio signal for the left-hand audio signal channel, will also disappear if the amplitude setting of the side signal and the mid-plane signal on the outputs 3, 4 of the stereo demodulator 1 is correct.

Figure 2B:
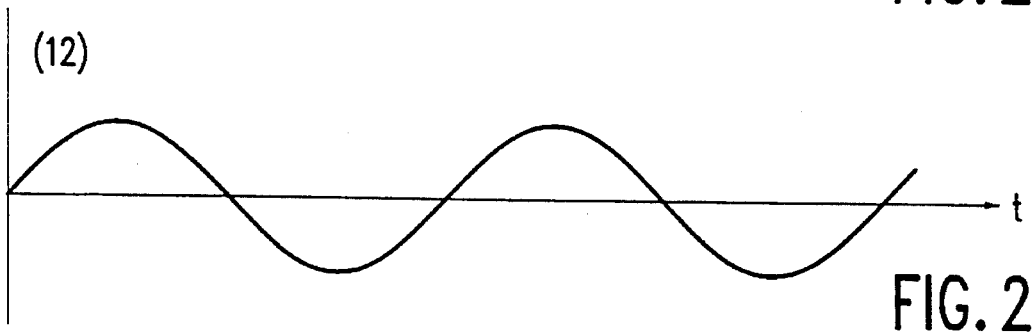
Figure 2C:
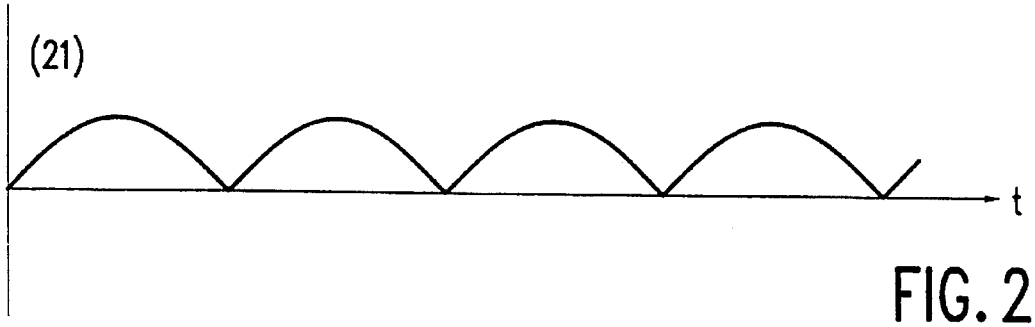

It is now assumed that the side signal has a negative amplitude error relative to the mid-plane signal, i.e. appears on the second output 4 of the stereo demodulator 1 with too small an amplitude. Without a correction of this too small amplitude, a wave, whose waveform as a function of the time t is shown in FIG. 2*b*, will be produced on the second output 12 of the dematrixing circuit 6 during dematrixing in this circuit. This wave is applied to the second input 20 of the (first) mixer circuit 19, in which it is multiplied by the rectangular signal from the first input 18. This provides a rectification, whose result is shown in FIG. 2*c*, which represents the resulting (first) rectified signal on the output 21 of the (first) mixer circuit 19.

For the correction of the crosstalk, which is represented by the signals in FIG. 2*b*, the amplitude of the side signal should be influenced in the adjustment circuit 8 so as to eliminate the afore-mentioned amplitude deviation between the mid-plane signal and the side signal. The second output signal on the second output 12 of the dematrixing circuit 6 and, as a consequence, also the (first) rectified signal on the output 21 of the (first) mixer circuit will then disappear.

For this control, i.e. this adjustment, the embodiment shown in FIG. 1 comprises a (first) control circuit 22 having an input 23 to which the signal from the output 21 of the (first) mixer circuit 19 is applied. The (first) control circuit derives from the (first) rectified signal, a (first) correction signal and supplies this to an output 24. For this purpose, the (first) control circuit 22 preferably comprises a low-pass stage and an integrator stage, which integrator stage essentially derives, from the d.c. component of the (first) rectified signal shown in FIG. 2*c*, a continuously rising (first) correction signal, whereas the a.c. component (the superimposed ripple) of the (first) rectified signal is rejected by the low-pass stage. The (first) correction signal thus formed is available on the output 24 of the (first) control circuit 22.

FIG. 1 further shows a (first) switching device 25 having a first input 26, a second input 27 and an output 28. For the sake of simplicity, the (first) switching device 25 is shown diagrammatically as a mechanical switch which can selectively connect the first input 26 or the second input 27 to the output 28 in a switch position "1" and a switch position "2", respectively. In practice, the (first) switching device 25 is preferably constructed by means of electronic switching means. Moreover, the output 29 of the (first) switching device 25 is connected to an adjustment input 28 of the adjustment circuit 8 to receive the (first) correction signal. The connection of the output 24 to the first input 26 is also connected to a correction-signal output 30, the second input 27 being connected to a correction-signal input 31. Preferably, the correction-signal output 30 can be connected to the input of a (first) storage device for the storage of the first correction signal, which device has an output which can be connected to the correction-signal input 31. As a result, this (first) storage device, not shown, can store a value of the (first) correction signal which can be read out when necessary.

In a first mode of operation of the circuit arrangement shown in FIG. 1, in which the afore-mentioned stereo signal with mid-plane and side signals, which are similar in the present example of a standard, the (first) switching device 25 is in its first switch position "1". As a result of this, the (first) correction signal is applied both to the (first) storage device, not shown, via the correction-signal output 30 in order to be stored, and to the adjustment circuit 8 via the adjustment input 29. Thus, the circuit arrangement forms a control loop for crosstalk cancellation. The (first) correction signal is varied until the second output signal on the second output 12 and hence the (first) rectified signal shown in FIG. 2*c* disappear. The first correction signal on the output 24 of the (first) control circuit 22 is then constant and the signal with this constant value can be stored in the (first) storage device.

In a second mode of operation, the (first) switching device 25 is set to its second switch position "2". The control loop described above is then interrupted. Now the adjustment circuit 8 receives the stored constant (first) correction signal from the (first) storage device via the correction-signal input 31 and the adjustment input 29. In this second mode, the stereo signal on the input 2 may have arbitrary waveforms, yet guaranteeing a crosstalk-free operation of the circuit arrangement. Thus, the first mode of operation of the circuit arrangement serves for the adjustment of this arrangement and the second mode serves for its use for the (destination-dependent) conversion of, for example, stereo signals to be reproduced.

Figure 2D:
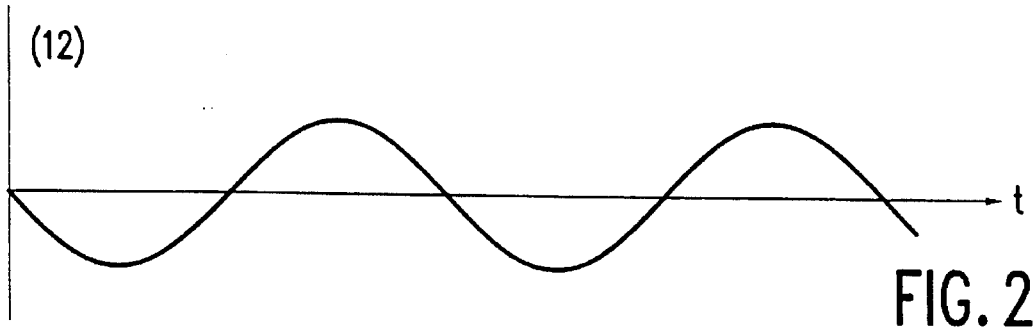
Figure 2E:
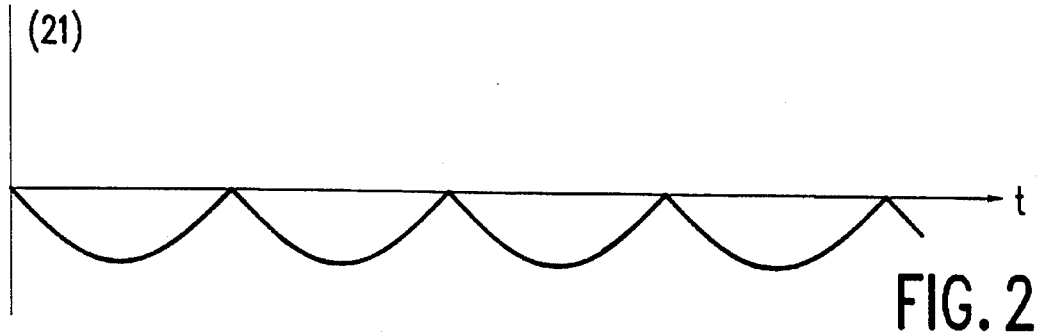

FIGS. 2*d* and *e*, in the same way as FIGS. 2*b* and *c*, respectively, show that in the first mode of operation of the circuit arrangement, a positive amplitude deviation relative to the mid-plane signal occurs. The signal appearing on the second output 12 of the dematrixing circuit 6 and shown in FIG. 2*d* is then negative in comparison with that shown in FIG. 2*b*; a negative rectified signal is obtained on the output 21 of the (first) mixer circuit 19. From this signal a (first) correction signal is derived, which, by means of the adjustment circuit 8, reduces the amplitude of the side signal and thereby provides crosstalk correction.

Figure 3:
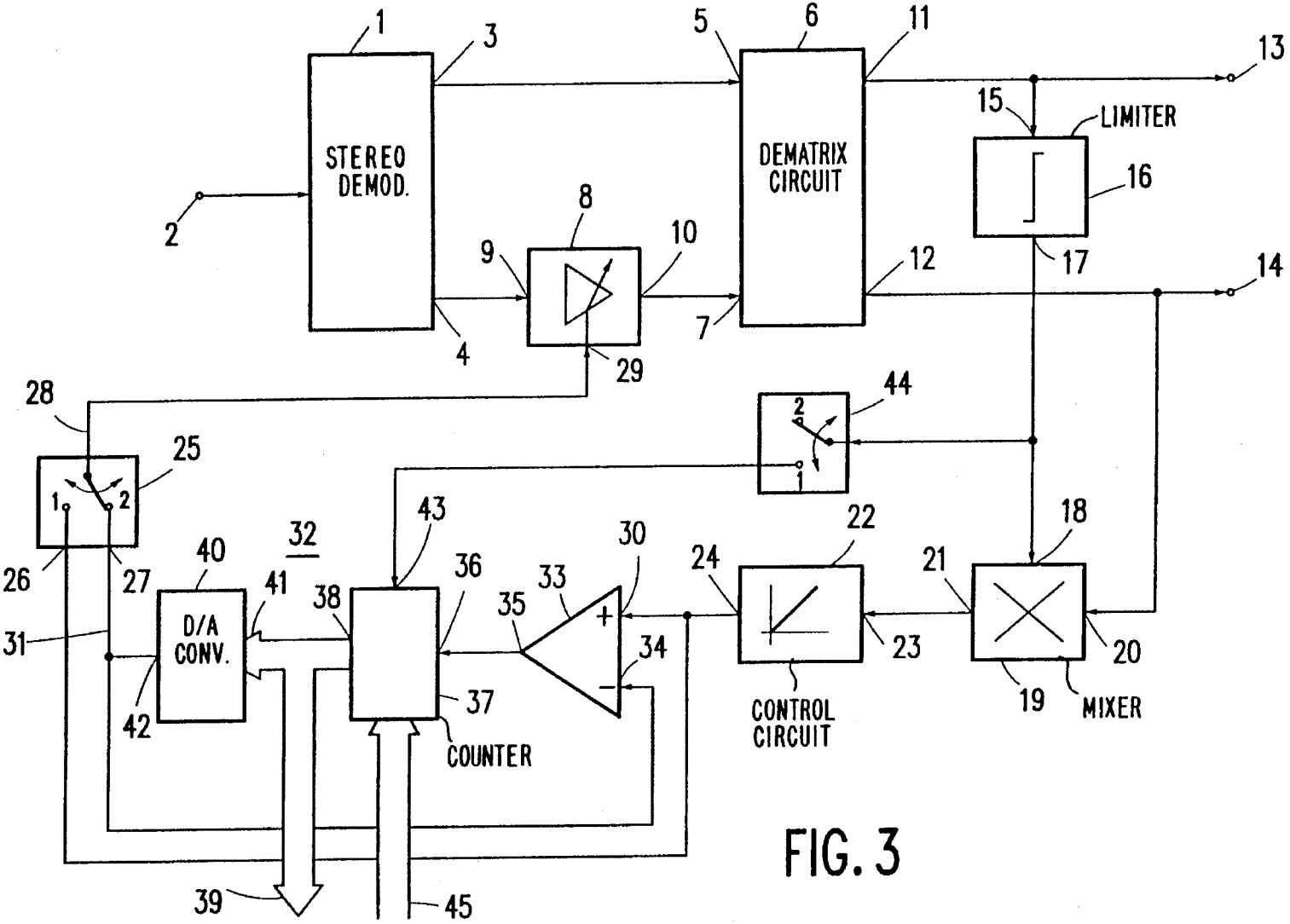
FIG. 3 shows a circuit arrangement in accordance with FIG. 1 in more detail.

FIG. 3 shows a further embodiment of the circuit arrangement in accordance with the invention comprising a (first) conversion circuit 32 arranged in the signal paths for the (first) correction signal between the (first) control circuit 22, the adjustment circuit 8 and the (first) storage device (not shown). Circuit elements already described with reference to FIG. 1 bear the same reference numerals.

The (first) conversion circuit 32 in particular enables the (first) correction signal to be stored in digital form in the (first) storage device. For this purpose the (first) conversion circuit 32 comprises a (first) device for converting the (first) correction signal from the output 24 of the (first) control circuit 22 into digital form. In the present embodiment shown in FIG. 3 this (first) device comprises a (first) comparator stage 33 whose non-inverting first input 30 receives the correction signal and whose inverting second input 34 is connected to the correction signal input 31. An output 35 of the (first) comparator stage 33 is connected to a counting-direction input 36 of a (first) counter stage 37, whose counting direction can be determined by the output signal from the output 35 of the (first) comparator stage 33. The count of the (first) counter stage 37 appears in digital form on an output 38 of this (first) counter stage 37 as a (first) correction signal. In this form it can be applied to the (first) storage device (not shown) via a (first) digital signal output 39 in order to be stored in said storage device.

Whereas for converting the (first) correction signal into digital form, the (first) device comprises the (first) comparator stage 33 and the (first) counter stage 37, the (first) device comprises a (first) digital-to-analog converter stage 40 for reconverting the (first) correction signal from this digital form, which stage has its digital input 41 connected to the output 38 of the (first) counter stage 37 and the (first) digital signal output 39 and which has its analog output 42 coupled to the correction signal input 31 and the inverting second input 34 of the (first) comparator stage 33. The (first) digital-to-analog converter stage 40 converts the (first) correction signal from the digital form, in which it can be stored in the (first) storage device, into a form in which it can be applied to the adjustment circuit 8 via the adjustment input 29. A reference signal is supplied to the (first) comparator stage 33 via the connection of the analog output 42 to the inverting second input 34 of the this comparator stage, with which reference signal the correction signal from the output 24 of the (first) control circuit 22 can be compared. Depending on the result of this comparison the (first) counter stage 37 is set to count up or counting-down. By means of count pulses of a clock signal, which can be applied via a counting input 43, the count of the (first) counter stage 37 is changed in the counting direction defined by the (first) comparator stage 33 until it corresponds to the digital form of the (first) correction signal on the output 24. The adaptation of the count is effected in the first mode, in which the (first) switching device 25 is in the switch position "1". Thus, the then available control loop of FIG. 3 will be unchanged in comparison with that of FIG. 1 and, as a consequence, crosstalk signals will be controlled without being influenced by the process in the (first) conversion circuit 32, i.e. correction for this crosstalk will be effected without being influenced thereby. The (first) conversion circuit 32 is merely set to the final value of the (first) correction signal and applies this to the (first) storage device.

The clock signal is applied from the output 17 of (first) limiter circuit 16 to the counting input 43 of the (first) counter stage 37 via a switch 44, which means that it is derived from the (first) amplitude-limited signal. For the adjustment, the switch 44 is in the switch position "1". It is obvious that preferably the switch 44, which for the sake of simplicity is shown as a mechanical switch in FIG. 3, can also be constructed by means of electronic elements.

In the second mode of the embodiment of the circuit arrangement in accordance with the invention shown in FIG. 3, the (first) switching device 25 and the switch 44 are set to their switch positions "2". This is effected after adjustment has been completed for a destination-dependent processing of, for example, a stereo signal to be reproduced. The counting input 43 then no longer receives any counting pulses, as a result of which the count of the (first) counter stage 37 remains unchanged and, consequently, the analog output 42 supplies a constant value as the (first) correction signal. This signal is applied to the adjustment circuit 8 via the (first) switching device 25, the control loop being interrupted as described with reference to FIG. 1.

In order to avoid, for example, that the adjustment process is repeated each time that the circuit arrangement for stereo signal conversion is put into operation, the (first) counter stage 37 can also be set to the count corresponding to the (first) correction signal for a correct adjustment, in that the correct (first) correction signal in digital form is applied from the (first) storage device to a preset input 45 of the (first) counter stage 37. When the circuit arrangement is put into operation again the (first) counter stage 37 is then immediately set to a correct count and the circuit arrangement can be operated in its second mode immediately after it is put into operation. This is particularly advantageous when the circuit arrangement in accordance with the invention, if desired in conjunction with other signal processing stages, is connected to a bus system for controlling the cycles of operation, via which the appropriate correction signal in digital form from the (first) storage device can be made available.

Figure 4:
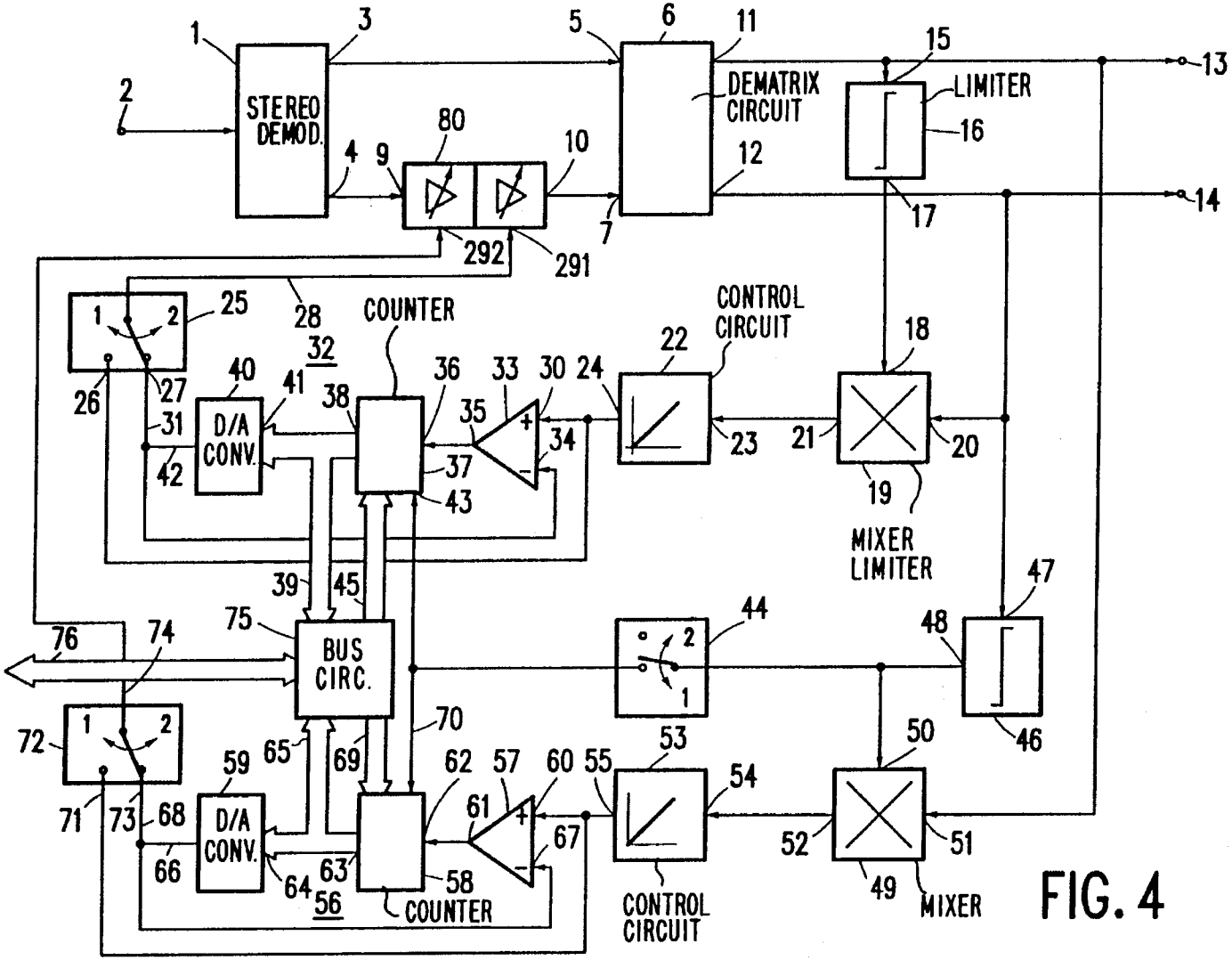
FIG. 4 shows an example of a circuit arrangement in accordance with the invention adapted for frequency-dependent adjustment.

FIG. 4 shows a further embodiment of the circuit arrangement in accordance with the invention which comprises two control circuits for the preferably frequency-selective correction of crosstalk between the two audio signal channels, in which Figure elements corresponding to parts of the embodiments described hereinbefore again bear corresponding reference numerals.

The second control circuit shown in FIG. 4 comprises a second limiter circuit 46 whose input 47 is connected to the second output 12 of the dematrixing circuit 6 and which supplies the second output signal. The second limiter circuit 46 can transform this second output signal into an at least substantially rectangular second amplitude-limited signal of the same frequency, which is available on an output 48 of the second limiter circuit 46.

The adjustment circuit shown in FIG. 4 further comprises a second mixer circuit 49 having a first input 50 connected to the output 48 of the second limiter circuit 46. A second input 51 of the second mixer circuit 49 is connected to the first output 11 of the dematrixing circuit 6. In this way the second mixer circuit 49 is capable of producing a second rectified signal on its output 52, which signal can be obtained by multiplying the second amplitude-limited signal from the output 48 of the second limiter circuit 46 by the first output signal from the first output 11 of the dematrixing circuit 6. The second rectified signal from the output 52 of the second mixer circuit 49 can be applied to a second control circuit 53 via its input 54, which is connected to the output 52. The second control circuit 53 further has an output 55 on which a second correction signal can be produced, which signal can be derived from the second rectified signal in the second control circuit 53.

The adjustment circuit in accordance with the embodiment shown in FIG. 4 further comprises a second conversion circuit 56, which is of the same construction as the first conversion circuit 32 and which consequently comprises a second comparator stage 57, a second counter stage 58 and a second digital-to-analog converter stage 59. The second comparator stage 57 and the second counter stage 58 form a second arrangement for converting the second correction signal into a digital form in which it can be stored in a second storage device, not shown. For this purpose, a non-inverting first input 60 of the second comparator stage 57 receives a second correction signal as it, is connected to the output 55 of the second control circuit 53. An output 61 of the second comparator stage 57 is coupled to a counting-direction input 62 of the second counter stage 58, which has an output 63 on which the count of the second counter stage 58 is available in digital form as a second correction signal and which is connected to a digital input 64 of the second digital-to-analog converter stage 59. Moreover, the output 63 of the second counter stage 58 is connected to a second digital signal output 65, via which the second correction signal can be applied in digital form to the second storage device. An analog output 66 of the second digital-to-analog converter stage 59 is connected to an inverting second input 67 of the second comparator stage 57 to supply the second correction signal after re-conversion into analog form as a reference signal to the second comparator stage 57. The analog output 66 of the second digital-to-analog converter stage 59 is also connected to a second correction signal input 68.

Similarly to the first counter stage 37, the second counter stage 58 has a preset input 69 via which the second counter stage 58 can be set to a presettable count. A counting input 70 has been provided to apply counting pulses to the second counter stage 58. In the circuit arrangement shown in FIG. 4 the counting inputs 43, 70 of the two counter stages 37, 58 are connected to the output 48 of the second limiter circuit 46 via the switch 44 in order to derive the clock signal from the second amplitude-limited signal appearing on this output.

In FIG. 4, the second correction signal output 55 is connected to a first input 71 of a second switching device 72, whose second input 73 is coupled to the second correction signal input 68. An output 74 of the second switching device 72 is connected to a second adjustment input 292 of an adjustment circuit 80, whose first adjustment input 291 is connected to the output 28 of the first switching device 25 and which takes the place of the adjustment circuit 8 in the embodiments shown in FIGS. 1 and 3. Preferably, the adjustment circuit 80 is constructed in a manner such that the amplitude of different spectral components of the side signal from the second output 4 of the stereo demodulator 1 can be influenced by the first and the second correction signal on the adjustment inputs 291, 292. In the adjustment circuit 80 it is possible, for example, to actuate a bass control via the first correction input 291 and a treble control via the second correction input 292. Likewise, other spectral adjustment possibilities can be realized. These adjustments are always effected by means of two mutually independent control circuits.

The circuit arrangement shown in FIG. 4 has a bus circuit 75 which can receive and supply data and commands via a data line 76. The present adjustment circuit can be connected to the storage devices for the storage of the correction signals via this bus circuit 75 and the data line 76, which are connected to the preset inputs 45, 69 and the digital signal outputs 39, 65. Moreover, there may be operational links, not shown, from the bus circuit 75 to the switching devices 25, 72 and to the switch 44, by means of which they can be set to the first mode and the second mode.

In a method of operating the circuit arrangement in accordance with the embodiment shown in FIG. 4, the stereo signal applied to the stereo demodulator 1 via the input 2 in the first mode is a test signal in which the mid-plane signal is formed by additive mixing and the side signal by subtractive mixing of a low-frequency first test wave and a high-frequency second test wave. In particular, the second test wave is in phase opposition in the side signal and in the mid-plane signal, whereas the first test wave is in phase in the mid-plane signal and the side signal. The frequencies of the test waves are selected in accordance with the spectral adjustment possibilities of the adjustment circuit 80 and should be non-integral multiples of one another. For example, the first test wave may have a frequency of 300 Hz and the second test wave may have a frequency of approximately 3.1 kHz.

During dematrixing in the dematrixing circuit 6, if the amplitude of the mid-plane signal and the side signal on the respective outputs 3 and 4 of the stereo demodulator have been adjusted correctly, a first output signal for the left-hand audio signal channel will appear on the first output 11, which first output signal contains only components of the first test wave (of, for example, 300 Hz), whereas the second output signal on the second output 12 for the right-hand audio signal channel contains only components of the second test wave (of, for example, 3.1 kHz). However, if the amplitude ratio between the mid-plane signal and the side signal is not correct, which may also occur due to an incorrect setting of the adjustment circuit 80, the first output signal on the first output 11 will contain residual components of the second test wave (for example 3.1 kHz) resulting from crosstalk, whereas the second output signal on the second output 12 will contain residual components of the first test wave (for example, 300 Hz). On the output 17 of the first limiter circuit 16 this yields a first amplitude-limited, at least substantially rectangular signal having the frequency of the first test wave (for example 300 Hz), whereas on its output 48 the second limiter circuit 46 supplies a second amplitude-limited, at least substantially rectangular signal having the frequency of the second test wave (for example, 3.1 kHz).

A first rectified signal and a second rectified signal with d.c. components are generated on the respective outputs 21 and 52 of the mixer circuits 19 and 49 by mixing therein, on the one hand, the signals appearing on the respective outputs 17 and 48 of the first and the second limiter circuit 16 and 46 and, on the other hand, the residual components of the test waves of the same frequency produced on the outputs 11 and 12 of the dematrixing circuit 6 as a result of crosstalk. Thus, in the first mixer circuit the rectangular signal on the output 17, derived from the first test wave, and the residual component of the first test wave, appearing on the output 12 as a result of crosstalk, produce a d.c. component of the rectified signal appearing on the output 21 of this mixer circuit. Likewise, a d.c. component is obtained from the high-frequency rectangular signal on the output 48 and the residual components of the second test wave on the first output 11. Mixing of all the other signal components applied to the mixer circuits 19 and 49 produce a.c. components in the rectified signals on the respective outputs 21 and 52 because the frequencies of the test waves are in a non-integral ratio to one another. These a.c. components are filtered out in the subsequent control circuits 22 and 53. Thus, a correction signal is applied to the first adjustment input 291 of the adjustment circuit 80 via the first switching device 25, which signal depends exclusively on crosstalk of the first test signal to the second output 12 of the dematrixing circuit 6 and is reduced to zero by adjusting the amplitude of the side signal in the frequency range of the first test wave. Likewise, a second correction signal, which reduces crosstalk of the second test wave to the first output of the dematrixing circuit 6 to zero, is supplied via the second switching device 72, said signal merely influencing the frequency range of the second test wave via the second adjustment input 292 independently of the first adjustment input 291.

However, even if the amplitude of the first test wave is, perhaps slightly, influenced by the second correction signal on the second adjustment input 292 and, conversely, the second test wave by the first correction signal on the first adjustment input 291, the concurrent action of the two control circuits will provide complete cancellation of crosstalk, i.e. a correct adjustment of the circuit arrangement. Thus, this does not require a time-consuming iterative adjustment process alternating with a repeated adjustment by the first and the second correction signal. In the embodiment shown in FIG. 4 the clock signal for the counting inputs 43 and 70 of the counter stages 37 and 58, respectively, is derived from the second test wave because this provides a faster response of the counter stages 37, 58 owing to its high frequency. The adjustment process in this first mode is preferably controlled by the bus circuit 75. When adjustment has been completed the switching devices 25, 72 and the switch 44 are set to their switch positions "2", after which the adjustment circuit 80 is operated with constant values for the first and the second correction signal.

I claim:

1. A circuit arrangement for converting a stereo signal comprising a mid-plane signal and a side signal into an output signal for each of two audio signal channels, which arrangement comprises an adjustment circuit for minimizing crosstalk between the output signals, comprising:

a first limiter circuit adapted to receive a first one of the output signals and to transform it into an at least substantially rectangular first amplitude-limited signal of the same frequency as that of the first one of the output signals, a first mixer circuit for deriving a first rectified signal by multiplying the first amplitude-limited signal by a second one of the output signals, a first control circuit for deriving a first correction signal from the first rectified signal, an adjustment circuit for influencing the amplitude of at least one of the mid-plane signal and the side signal by means of the first correction signal, a first storage device coupled to the first control circuit for storing the first correction signal, and a first switching device by means of which, in a first mode of the circuit arrangement, the first correction signal is applied to the adjustment circuit, and by means of which, in a second mode of the circuit arrangement, the first correction signal stored in the first storage device is applied to the adjustment circuit.

2. A circuit arrangement as claimed in claim 1, further comprising a first conversion circuit arranged in signal paths for the first correction signal between the first control circuit, the adjustment circuit and the first storage device, for enabling the first correction signal supplied by the first control circuit to be converted into a form in which it can be stored in the first storage device, and enabling a stored first correction signal to be converted into a form required for application to the adjustment circuit.

3. A circuit arrangement as claimed in claim 2, wherein the first correction signal is adapted to be stored in the first storage device in digital form and the first conversion circuit comprises a first device for converting the first correction signal into said digital form and a first device for re-converting it from said digital form.

4. A circuit arrangement as claimed in claim 3, wherein the first device for converting the first correction signal into digital form comprises a first comparator stage for receiving at a first input the first correction signal from the first control circuit, and a first counter stage having a counting direction defined by an output signal of the first comparator stage and whose count can be stored in digital form in the first storage device as the first correction signal, and the means for re-converting the first correction signal from digital form comprises a first digital-to-analog converter stage for converting the first correction signal from the digital form into a form in which it can be applied to the adjustment circuit and in which it can also be applied to a second input of the first comparator stage for comparison with the first correction signal supplied by the first control circuit.

5. A circuit arrangement as claimed in claim 4, wherein the first correction signal stored in the first storage device is applied to the first counter stage for presetting the first counter stage to a corresponding count.

6. A circuit arrangement as claimed in claim 4, wherein a clock signal is derived from the first amplitude-limited signal and is applied to the first counter stage as a counting signal.

7. A circuit arrangement as claimed in claim 1, wherein the first control circuit comprises an integrator stage and a low-pass stage.

8. A circuit arrangement as claimed in claim 1, which comprises:

a second limiter circuit adapted to receive the second output signal and to transform said signal into an at least substantially rectangular second amplitude-limited signal of the same frequency as that of the second output signal, a second mixer circuit for deriving a second rectified signal by multiplying the second amplitude-limited signal by the first output signal, a second control circuit for deriving a second correction signal from the second rectified signal, a second storage device for storing the second correction signal, a second switching device by means of which, in a first mode of the circuit arrangement, the second correction signal can be applied both to the second storage device in order to be stored and to the adjustment circuit, and by means of which, in a second mode of the circuit arrangement, the second correction signal stored in the second storage device can be applied to the adjustment circuit, and wherein in the adjustment circuit the amplitude of at least one of the mid-plane signal and the side signal are influenced in mutually different frequency ranges by means of respective first and second correction signals.

9. A method of operating a circuit arrangement as claimed in claim 1, wherein in the first mode, the mid-plane signal and the side signal of the stereo signal correspond, said method comprising adjusting the first correction signal to a value at which the second output signal disappears.

10. A method of operating a circuit arrangement as claimed in claim 1, wherein in the first mode the mid-plane signal of the stereo signal corresponds to half the side signal, said method comprising adjusting the first correction signal to a value at which the second output signal disappears.

11. A method of operating a circuit arrangement as claimed in claim 8 which comprises, applying a test signal as a stereo signal in the first mode, wherein the test signal includes the mid-plane signal formed by additive mixing and the side signal by subtractive mixing of a low-frequency first test wave and a high-frequency second test wave, and the second test wave appears in the side signal in phase opposition to the second test wave in the mid-plane signal, the frequency of the second test wave being a non-integral multiple of the frequency of the first test wave, adjusting the first correction signal to a value at which components of the first test wave in the second output signal disappear, and adjusting the second correction signal to a value at which components of the second test wave in the first output signal disappear.

12. A circuit arrangement as claimed in claim 5, wherein a clock signal is derived from the first amplitude-limited signal and is applied to the first counter stage as a counting signal.

13. A circuit arrangement as claimed in claim 1, wherein said adjustment circuit is in a circuit path through which the side signal passes.

14. A circuit arrangement as claimed in claim 1, further comprising:

an analog/digital converter and a digital/analog converter coupled in cascade between an output of the first control circuit and an input of the first switching device, and wherein said first storage device is a digital storage device having its input coupled to an output of the analog/digital converter.

* * * * *